US007973639B2

(12) United States Patent
Ihle et al.

(10) Patent No.: US 7,973,639 B2
(45) Date of Patent: Jul. 5, 2011

(54) PTC-RESISTOR

(75) Inventors: Jan Ihle, Deutschlandsberg (AT); Werner Kahr, Deutschlandsberg (AT); Markus Rath, Deutschlandsberg (AT)

(73) Assignee: EPCOS AG, Munich (DE)

( * ) Notice: Subject to any disclaimer, the term of this patent is extended or adjusted under 35 U.S.C. 154(b) by 494 days.

(21) Appl. No.: 11/950,738

(22) Filed: Dec. 5, 2007

(65) Prior Publication Data

US 2009/0146774 A1 Jun. 11, 2009

(51) Int. Cl.
*H01C 7/10* (2006.01)

(52) U.S. Cl. ..... 338/22 R; 29/610.1

(58) Field of Classification Search ..... 338/22 R
See application file for complete search history.

(56) References Cited

U.S. PATENT DOCUMENTS

| | | | | |
|---|---|---|---|---|
| 4,189,509 | A * | 2/1980 | Hill | 427/102 |
| 4,189,700 | A | 2/1980 | Hill | |
| 4,325,341 | A | 4/1982 | Yamauchi et al. | |
| 4,713,524 | A | 12/1987 | Leo et al. | |
| 4,898,142 | A | 2/1990 | Van Wechem et al. | |
| 5,117,482 | A | 5/1992 | Hauber | |
| 5,218,943 | A | 6/1993 | Takeda et al. | |
| 5,361,990 | A | 11/1994 | Pimentel | |
| 5,400,969 | A | 3/1995 | Keene | |
| 5,498,855 | A | 3/1996 | Deevi et al. | |
| 5,551,400 | A | 9/1996 | Rice et al. | 123/531 |
| 5,861,795 | A * | 1/1999 | Glatz-Reichenbach et al. | 338/22 R |
| 5,934,252 | A | 8/1999 | Hafner et al. | 123/468 |
| 6,144,286 | A | 11/2000 | Moos et al. | |
| 6,320,167 | B1 | 11/2001 | Lindemann et al. | |
| 6,340,015 | B1 | 1/2002 | Benedikt et al. | |
| 6,806,519 | B2 * | 10/2004 | Chu et al. | 257/234 |
| 2001/0052553 | A1 | 12/2001 | Hokao | |
| 2002/0131328 | A1 | 9/2002 | Bowens et al. | |
| 2003/0183210 | A1 | 10/2003 | Guettler et al. | |
| 2004/0028396 | A1 | 2/2004 | Russegger | |
| 2005/0079458 | A1 | 4/2005 | Waronitza et al. | |
| 2005/0140492 | A1 | 6/2005 | Chu et al. | |

FOREIGN PATENT DOCUMENTS

| | | |
|---|---|---|
| DE | 27 53 766 | 6/1979 |
| DE | 29 911 711 | 11/1999 |
| DE | 198 18 375 | 11/1999 |
| DE | 198 60 919 | 2/2000 |
| DE | 100 12 675 | 9/2001 |
| DE | 103 47 509 | 5/2005 |
| EP | 0 284 120 | 9/1988 |
| EP | 0 307 206 | 9/1988 |
| EP | 0 415 428 | 6/1994 |
| EP | 0 809 262 | 11/1997 |

(Continued)

OTHER PUBLICATIONS

Beebhas C. Mutsuddy et al. "Ceramic Injection Molding" Chapman & Hall, London 1995 ISBN 0412538105.

(Continued)

*Primary Examiner* — Kyung Lee
(74) *Attorney, Agent, or Firm* — Fish & Richardson P.C.

(57) ABSTRACT

A PTC-resistor includes a base body made of a ceramic material with a positive temperature coefficient of resistance. The base body extends along a median plane, and is confined by surfaces. At least one surface is configured to electrically connect the base body. An area of the at least one surface is larger than an area of a parallel projection of the base body in a direction perpendicular to the median plane.

13 Claims, 2 Drawing Sheets

FOREIGN PATENT DOCUMENTS

| | | |
|---|---|---|
| EP | 0 852 292 | 7/1998 |
| GB | 1 486 945 | 9/1977 |
| GB | 2 097 778 | 11/1982 |
| JP | 59-144702 | 8/1984 |
| JP | 59-221451 | 12/1984 |
| JP | 60-071573 | 4/1985 |
| JP | 01-066901 | 3/1989 |
| JP | 02-097461 | 4/1990 |
| JP | 2001-181058 | 7/2001 |
| JP | 2005-286035 | 10/2005 |
| WO | WO2006/130938 | 12/2006 |

OTHER PUBLICATIONS

Jayanthi S. et al. "Effect of Segregative Addivities on the Positive Temperature Coefficient in Resistance Characteristics of n-baTiO3 Ceramics" J. of Material Science: Mater Electron,, vol. 17, No. 11, Nov. 1, 2006 pp. 883-897.

Shut et al "PTCR-Ceramics Obtained of Barium Titanate Powders with Different Crystallinity" Apps of Ferroelectrics, 2006 15$^{th}$ IEEE Intl Symp. Nov. 21, 2007 pp. 1-4 XP 002517334.

Wegmann M. et al "Rapid-Response Ceramic Thermistor Fibers" Proc of IEEE Sensors 2003, 2$^{nd}$ IEEE Intl Conf. on Sensors, Toronto Canada, Oct. 22-24, 2003, NY, vol. 1, Oct. 22, 2003 pp. 626-630 XP 010692337.

International Search Report and Written Opinion for International Application No. PCT/EP2008/066545, Mar. 31, 2009, 12 pages.

International Search Report and Written Opinion for International Application No. PCT/EP2008/066720, Mar. 17, 2009, 12 pages.

International Search Report and Written Opinion for International Application No. PCT/EP2008/066724, Mar. 17, 2009, 10 pages.

International Search Report and Written Opinion for International Application No. PCT/EP2008/066655, Apr. 7, 2009, 11 pages.

International Search Report and Written Opinion for International Application No. PCT/EP2008/066658, May 6, 2009, 11 pages.

U.S. Appl. No. 11/950,659, filed Dec. 5, 2007, including application as filed (including pending claims).

U.S. Appl. No. 11/950,666, filed Dec. 5, 2007, including application as filed (including pending claims).

U.S. Appl. No. 11/950,669, filed Dec. 5, 2007, including application as filed (including pending claims).

U.S. Appl. No. 11/950,724, filed Dec. 5, 2007, including application as filed (including pending claims).

U.S. Appl. No. 11/950,744, filed Dec. 5, 2007, including application as filed (including pending claims).

Office action and response history of U.S. Appl. No. 11/950,744 to Mar. 3, 2010.

International Search Report and Written Opinion for corresponding application PCT/EP2008/066551.

Office Action from related U.S. Appl. No. 11/950,666, dated May 18, 2010.

Response to Office Action from related U.S. Appl. No. 11/950,666, filed Aug. 12, 2010.

Office Action from related U.S. Appl. No. 11/950,669, dated Jul. 21, 2010.

Response to Office Action from related U.S. Appl. No. 11/950,744, filed Jun. 30, 2010.

Notice of Allowance from related U.S. Appl. No. 11/950,744, dated Oct. 7, 2010.

Authorized officer Thukhanb T. Nguyen, Final Office Action in U.S. Appl. No. 11/950,669 mailed Dec. 28, 2010, 7 pages.

Fish & Richardson, Request for Continued Examination and Response to Final Office Action in U.S. Appl. No. 11/950,669 filed Mar. 7, 2011, 9 pages.

* cited by examiner

PTC-RESISTOR

CROSS-REFERENCE TO RELATED APPLICATIONS

The following patent applications, all of which were filed on the same day as this patent application, are hereby incorporated by reference into this patent application as if set forth herein in full: (1) U.S. patent application Ser. No. 11/950,724, entitled "Injection Molded PTC-Ceramics", Application Ref. P2007,1179USE; (2) U.S. patent application Ser. No. 11/950,744, entitled "Feedstock And Method For Preparing The Feedstock", Application Ref. P2007,1180USE; (3) U.S. patent application Ser. No. 11/950,659, entitled "Process For Heating A Fluid And An Injection Molded Molding", Application Ref. P2007,1182USE; (4) U.S. patent application Ser. No. 11/950,666, entitled "Injection Molded Nozzle And Injector And Injector Comprising The Injection Molded Nozzle", Application Ref. P2007,1183USE; and (5) U.S. patent application Ser. No. 11/950,669, entitled "Mold Comprising PTC-Ceramic", Application Ref. P2007,1181USE.

TECHNICAL FIELD

The disclosure relates to PTC-resistors having a base body comprising a ceramic material with a positive temperature coefficient of the resistance, at least in a certain range of temperature.

BACKGROUND

The rise of the electric resistivity ρ as a function of the temperature follows a logarithmic curve in a certain temperature range. PTC-resistors may be produced in the form of disks with a circular, quadratic or rectangular shape.

Such PTC-resistors are suitable for a wide range of applications, in particular including overcurrent protection devices, switches and additionally as heaters.

PTC-resistors can be fabricated by dry pressing of a granulate. The variety of possible shapes of such PTC-resistors with a base body being manufactured by dry pressing is strongly restricted to very simple geometric structures such as disks like those mentioned above.

SUMMARY

A PTC-resistor is described having a base body comprising a ceramic material with a positive temperature coefficient of the resistance at least in a certain temperature range.

The base body mainly extends along a median layer (e.g., plane). In addition, the base body may also have an extension perpendicular to the median layer.

The base body is confined by different surfaces whereby at least one of the surfaces is configured to electrically contact the base body.

The area of the at least one surface is larger than the area of the parallel projection of the base body in a direction perpendicular to the median surface.

In such a PTC-resistor a surface-volume ratio of the ceramic base body can be achieved which provides a decreased resistance usually measured at a temperature of 25° C. and which gives a characterization of the PTC component.

A structured PTC-resistor is thus described with a surface-volume ratio increasing the surface-volume ratio of bulk PTC-resistors as described above.

By increasing the area of a surface which is suitable for electrically connecting the base body of the PTC-resistor, the distribution of current flowing through the base body can be enhanced and the resistance of the component at 25° C. ($R_{25}$) reduced. A reduced resistivity at room temperature is beneficial for many applications of the PTC-resistor.

For example, in an overcurrent protection application the PTC-resistor is connected in series to circuitry to be prevented from overcurrent. Thus, the operating current which is required for the normal operation of the circuitry flows as a whole through the PTC-resistance. With low resistance at normal operation temperatures, voltage drop over the PTC-resistor can be minimized and thus power dissipation can be decreased.

In heating applications, a heating current flows through the PTC-resistor. According to Ohm's Law, the voltage required to provide a certain amount of heating current is lowered when the resistance of the PTC-resistor is lowered. This is beneficial in many applications where electrical voltage is limited, for example in automotive applications.

In an embodiment of the PTC-resistor, the at least one surface comprises bumps.

In another embodiment, the at least one surface of the base body comprises depressions.

In an embodiment, the at least one surface comprises both, that is, bumps as well as depressions.

The shape of the at least one surface may be obtainable by holding a sheet with a predetermined thickness.

In another embodiment, not only the shape of one surface of the base body but the base body as a whole is, with respect to its shape, obtainable by folding a sheet.

The shape of the base body may thus be received by folding a sheet in a direction perpendicular to the median layer. In an embodiment, a plurality of folds is carried out.

In another embodiment of the PTC-resistor, the at least one surface exhibits a plurality of folds, whereby each fold has a crest line running in parallel to the crest line of the adjacent fold.

Not only the at least one surface may exhibit a plurality of folds, but also the base body as a whole may be obtainable by applying a plurality of folds to a sheet.

Shaping the base body by folding the sheet may result in a base body which exhibits a wave-like shape.

In another embodiment of the PTC-resistor the resistance at room temperature decreases with an increase of the number of folds provided in the base body.

The PTC-resistor may be produced by injection molding using a certain kind of feedstock.

The injection moldable feedstock may comprise a ceramic filler, a matrix for binding the filler and a content that may be less than 10 ppm (parts per million) of metallic impurities.

The ceramic may for example be based on Bariumtitanate ($BaTiO_3$), which is a ceramic of the perovskite-type ($ABO_3$).

For the injection molding process a feedstock could be used comprising a ceramic filler, a matrix for binding the filler a content of less than 10 ppm of metallic impurities. One possible ceramic filler can be denoted by the structure:

$$Ba_{1-x-y}M_xD_yTi_{1-a-b}N_aMn_bO_3$$

wherein the parameters are x=0 to 0.5, y=0 to 0.01, a=0 to 0.01 and b=0 to 0.01. In this structure M stands for a cation of the valency two, like for example Ca, Sr or Pb, D stands for a donor of the valency three or four, for example Y, La or rare earth elements, and N stands for a cation of the valency five or six, for example Nb or Sb. Thus, a high variety of ceramic materials can be used wherein the composition of the ceramic may be chosen in dependency of the required electrical features of the later sintered ceramic.

The ceramic filler of the feedstock is convertible to a PTC-ceramic with low resistivity and a steep slope of the resistance-temperature curve. The resistivity of a PTC-ceramic made of such a feedstock can comprise a range from 3 Ωcm to 30000 Ωcm at 25° C. in dependence of the composition of the ceramic filler and the conditions during sintering the feedstock. The characteristic temperature $T_b$ at which the resistance begins to increase comprises a range of −30° C. to 340° C. As higher amounts of impurities could impede the electrical features of the molded PTC-ceramic the content of the metallic impurities in the feedstock is lower than 10 ppm.

The metallic impurities in the feedstock may comprise Fe, Al, Ni, Cr and W. Their content in the feedstock, in combination with one another or each respectively, is less than 10 ppm due to abrasion from tools employed during the preparation of the feedstock.

The preparation of the feedstock comprises using tools having such a low degree of abrasion that a feedstock comprising less than 10 ppm of impurities caused by said abrasion is obtained. Thus, preparation of injection moldable feedstocks with a low amount of abrasion caused metallic impurities is achieved without the loss of desired electrical features of the molded PTC-ceramic.

The tools used for preparation of the feedstock comprise coatings of a hard material. The coating may comprise any hard metal, such as, for example, tungsten carbide (WC). Such a coating reduces the degree of abrasion of the tools when in contact with the mixture of ceramic filler and matrix and enables the preparation of a feedstock with a low amount of metallic impurities caused by said abrasion. Metallic impurities may be Fe, but also Al, Ni or Cr. When the tools are coated with a hard coating such as WC, impurities of W may be introduced into the feedstock. However, these impurities have a content of less than 50 ppm. It was found that in this concentration, they do not influence the desired electrical features of the sintered PTC-ceramic.

Where injection molding is used to form the mold, care must be taken regarding the metallic impurities in the mold to ensure that the efficiency of the PTC-ceramic is not reduced. The PTC-effect of ceramic materials comprises a change of the electric resistivity ρ as a function of the temperature T. While in a certain temperature range the change of the resistivity ρ is small with a rise of the temperature T, starting at the so-called Curie-temperature $T_C$ the resistivity ρ rapidly increases with a rise of temperature. In this second temperature range, the temperature coefficient, which is the relative change of the resistivity at a given temperature, can have a value of 100%/K. If there is no rapid increase at the Curie-temperature the self regulating property of the mold is unsatisfactory.

BRIEF DESCRIPTION OF THE DRAWINGS

Other features of the PTC-resistor will become apparent from the following detailed description in combination with the accompanying drawings.

DETAILED DESCRIPTION

Figure 1:
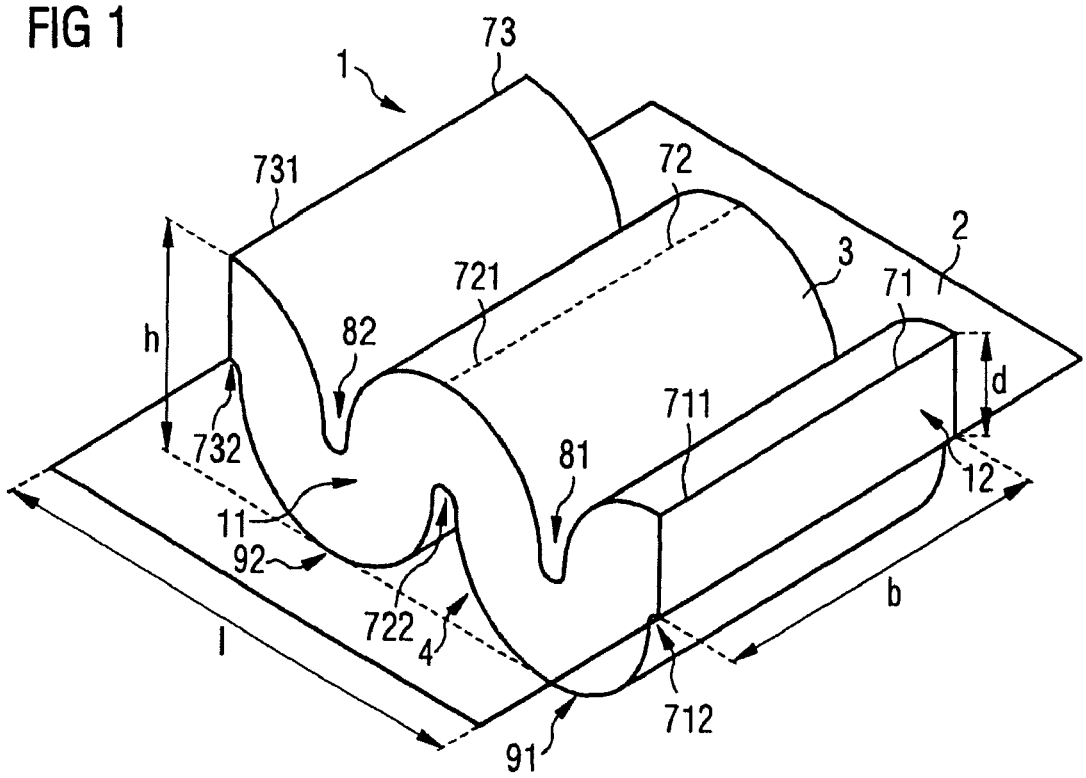
FIG. 1 is a perspective view of a PTC-resistor exhibiting a wave-like shape.

Referring to FIG. 1, a PTC-resistor is shown with a base body 1. The base body comprises a ceramic material with a positive temperature coefficient of the resistance. For example, the following material may be used as a ceramic material for example:

$$(Ba_{0.3290}Ca_{0.10505}Sr_{0.10969}Pb_{0.1306}Y_{0.005})$$

$$(Ti_{0.1502}Mn_{0.0007})O_{1.5045}$$

A sintered body of this ceramic material has a characteristic reference temperature $T_b$ of 122° C. and—depending on the conditions during sintering—a resistivity range from 40 to 200 Ωcm.

The specific resistance ρ of that ceramic material lies in a range between 20 and 200 Ωcm. In an embodiment of the PTC-resistor, the base body comprises no further constituents influencing the resistance of the PTC-resistor as well as the temperature behavior of the resistance.

The base body of the PTC-resistor extends along a median layer 2 which means that the large dimensions denoted b and l of the base body 1 run parallel to the median layer 2 and the smaller dimension denoted h extends perpendicular to the median layer.

The base body is confined by surfaces, for example a top surface denoted 3 and a bottom surface denoted 4. In addition, further confining surfaces denoted 11 and 12 are provided.

At least one of the surfaces is configured to electrically contact the base body. In the example of FIG. 1, the top surface 3 and a bottom surface 4 are configured to electrically connect the base body. This means that an electrical current which flows through the base body is distributed over the entire surface of the top surface 3 as well as over the entire surface of the bottom surface 4. This leads to a broad current distribution which helps to decrease the resistance of the PTC-resistor.

Figure 3:
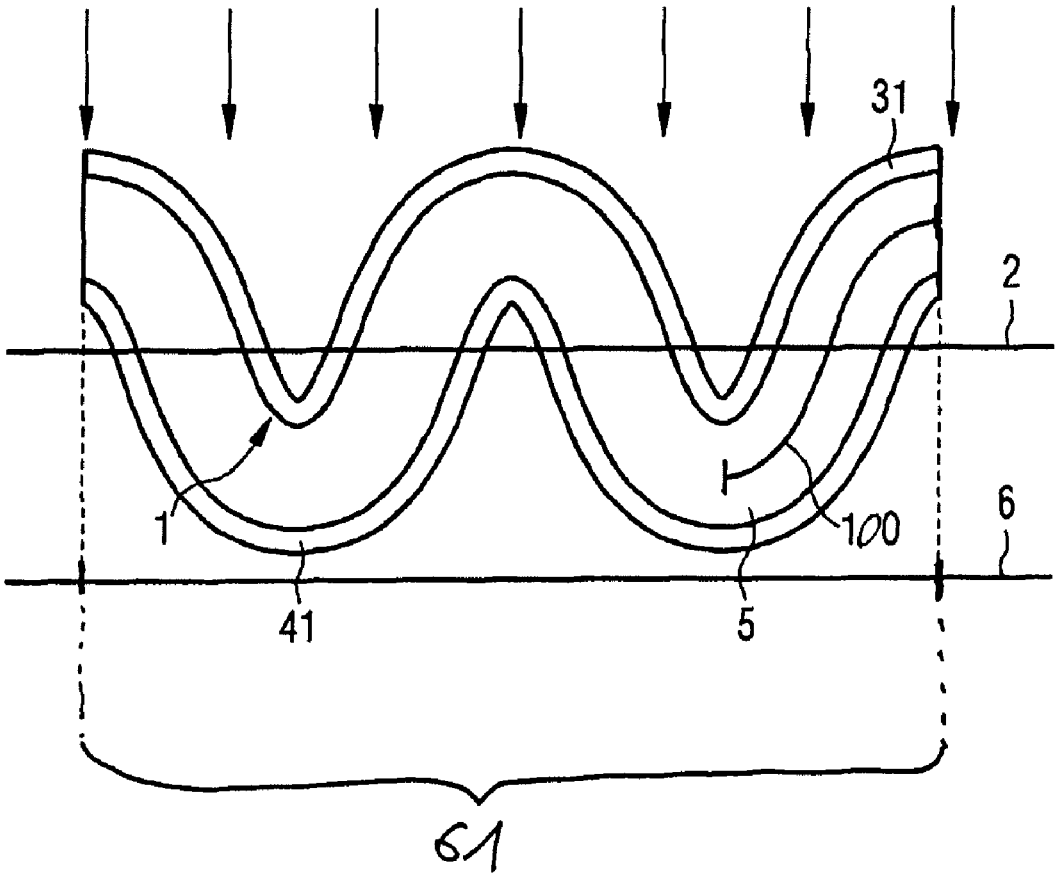
FIG. 3 is a cross-sectional view of a PTC-resistor as shown in FIG. 1.

A configuration for the electrical contact may be achieved by coating the respective surfaces as illustrated in FIG. 3. With reference to FIG. 3, conductive layers 31 and 41 are provided on the top and bottom of the base body 1, respectively. These conductive layers may be applied by screen printing of a paste containing metal particles or by coating techniques such as sputtering or vacuum deposition.

It may turn out to be convenient to further apply external terminals to the conductive layers 31 and 41, for example leads which may be chosen to be contact wires. The contact wires may be attached to the conductive layers by soldering or welding.

In FIG. 1 two different surfaces are shown which have an area larger than the area of the parallel projection of the base body. When speaking in terms of parallel projection, a projection perpendicular to the median surface is meant. Such a projection is illustrated in FIG. 3 via parallel light illustrated by the arrows falling in a perpendicular direction to the median layer 2 on top of the base body 1. The projection results in a shade on the projection layer 6 running in parallel to the median layer 2. The outline of the shadow 61 limits an area which is smaller than the area of the top and bottom surface 3, 4.

According to an embodiment of the PTC-resistor at least one surface comprises one or more bumps. In the example of FIG. 1, bumps 71, 72, 73 are provided on the top surface 3 of the base body 1.

In another embodiment the PTC-resistor has at least one surface which comprises depressions. In the example of FIG. 1, depressions 81 and 82 are provided on the top surface 3. Further depressions 712, 722, 732 are provided on the bottom surface 4.

The shape of the top surface 3 and the bottom surface 4 may be achieved by folding a sheet with a predetermined thickness. By forming the top surface and the bottom surface in the described manner, a base body 1 is obtained having a shape which may be achieved by folding a sheet.

In the example of FIG. 1 only the shape, not the manufacturing process, may be regarded as the outcome of a process where a sheet 5 has been folded such that folds 91 and 92 extend in a perpendicular direction to the median layer 2. Folding the sheet uniformly results in folds being separated from one another by a constant distance. Further, by a suitable folding process folds can be achieved which exhibit crest lines 711, 721, 731 which denote the top of each fold and which run parallel to one another.

While the shape of the base body shown in FIG. 1 may be achieved by folding a layer with a predetermined thickness, the manufacturing of a PTC-resistor as shown in FIG. 1 cannot be achieved by a method using injection molding of a PTC-ceramic Further, the PTC-resistor shown in FIG. 1 exhibits a wave-like shape which, in particular, becomes apparent from FIG. 3 showing a cross-section of the base body of FIG. 1.

The preparation of folds 91, 92 results in a shape of the base body 1 where for each bump 71, 72, 73 on the top surface 3, a corresponding depression 712, 722, 732 is provided on the opposite side, namely the bottom surface 4 of the base body.

In order to facilitate electrical contacting of the base body 1, conductive layers 31 and 41 are provided on the top surface 3 and the bottom surface 4 respectively as explained in FIG. 3.

Now turning to the geometrical dimensions of the base body shown in FIG. 1, the length of the base body is denoted l, the width of the base body is denoted b, the thickness of the layer being folded is denoted d and the height of the base body 1 is denoted h.

In general, a wide variety of different values for l, b, d, h may be chosen depending on the concrete application for the PTC-resistor.

The height of the base body is twice the thickness d of the layer plus 0.5 mm.

An example for the effect of folding a layer in order to achieve a decreased resistance for a PTC-resistor is shown in the table below.

In the first column the different types of components are given. All types are shaped according to the example of FIG. 1.

Here, S denotes the number of segments, whereby each segment runs from the top of a first projection on the one surface to the top of the adjacent projection on the opposite surface. An example for a segment as it is used in Table 1 is given in FIG. 3, denoted with reference numeral 100. In Table 1, h stands for the height of the base body 1 and is given in millimeters.

The dimensions D are also given in the Table, whereby D stands for the product of the length of the base body 1 (first item) and the width b of the base body (second item).

The respective size of the projection of the shadow area denoted P is given in $mm^2$. The resistance R measured at a temperature of 25° C. is given in the Table in Ω. In the next column of the Table the ratio of two areas is given. The first area A1 is the size of the shadow area of the type mentioned in the Table. The second area A1 is the area of a disc shaped resistor having the same mass as the waved resistor and at the same time having a thickness according to the respective value for h. Ratio is calculated as A2/A1.

In the last column, a minimum value for the maximum switching current in case of application of the resistor as a switch is also provided and is given in A.

The second area is the area of a PTC-resistor having the same mass of ceramic material but having a flat shape and having the thickness as given in the third column of the Table.

As can be seen from Table 1, the shadow area of the different embodiments is always smaller than the area of a disc-shaped PTC-resistor.

| Type | S | h[mm] | A(b × h) [mm × mm] | P[$mm^2$] | $R_{25}$[Ω] | Ratio [%] | I [A] |
|---|---|---|---|---|---|---|---|
| C810 | 7 | 2 | 17.5 × 5.0 | 263.0 | 2.6 | 50 | 7.0 |
| C830 | 6 | 2 | 15.0 × 13.1 | 196.5 | 3.5 | 63 | 4.1 |
| C840 | 4 | 2 | 10.0 × 11.5 | 114.5 | 6.0 | 48 | 2.2 |
| C850 | 4 | 2 | 10.0 × 6.9 | 69.0 | 10.0 | 60 | 1.5 |

All different types mentioned in the first column have a maximum voltage that can be applied of 265 V and a breakdown voltage of more or equal to 420 V.

Figure 2:
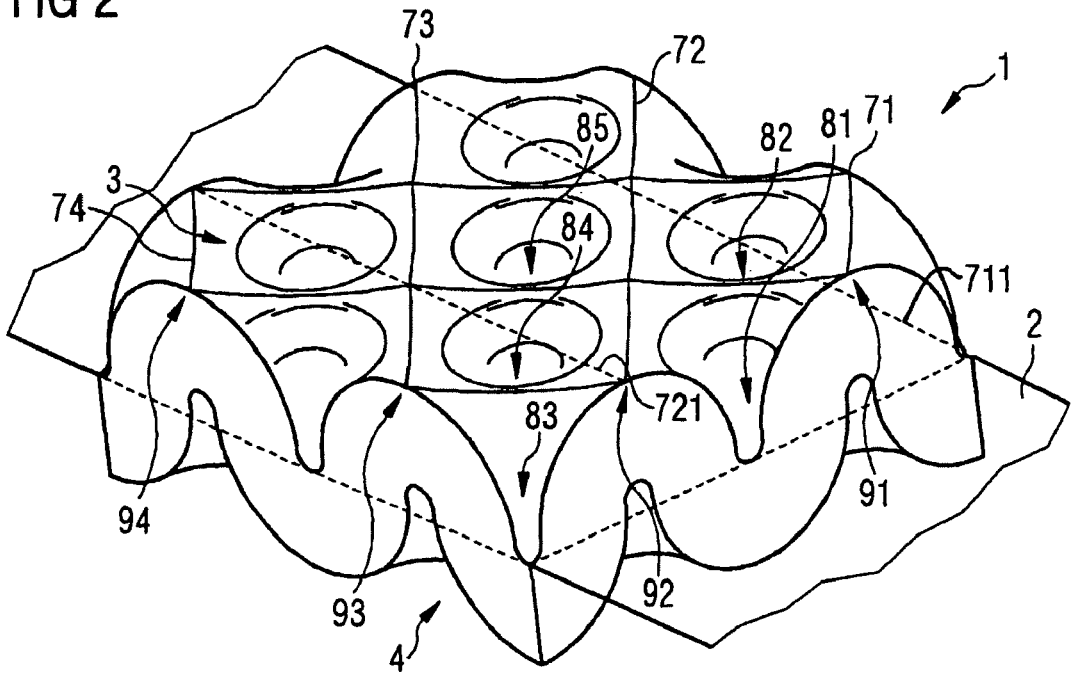
FIG. 2 is a perspective view of a PTC-resistor where two different wave-like structures are crossing each other.

Now turning to the example of FIG. 2, the number of bumps and depressions is increased with regard to the example of FIG. 1. The base body 1 in FIG. 2 has the shape of two waves, each wave comprising several folds. The first wave comprises the folds 91 and 92. The folds run in the same direction and exhibit the respective parallel crest lines 711, 721.

Another wave is shaped in the base body 1 outlining the folds 93 and 94. These folds also run in the same direction. The first group of folds 91, 92 runs in a perpendicular direction to the second group of folds 93, 94. Thus, FIG. 2 exhibits a kind of cross-over wave structure for the PTC-component.

The folds 91, 92, 93, 94 result in respective bumps on the top surface 3 of the base body 1 denoted 71, 72, 73, 74. Between the bumps 71, 72, 73, 74 depressions 81, 82, 83, 84, 85 are formed.

Due to the increased complexity of the surface with regard to the embodiment of FIG. 1, the surface to shadow area ratio is increased in the embodiment of FIG. 2.

What can be derived from Table 1 is that independent of the specific resistance of the PTC-ceramic, the resistance of the PTC-component can be decreased by increasing the number of segments used, see for example column 6 compared to column 2.

Other implementations are within the scope of the following claims. Elements of different implementations, including elements from applications incorporated herein by reference, may be combined to form implementations not specifically described herein.

What is claimed is:

1. A PTC-resistor comprising:

a sintered base body comprising a ceramic material with a positive temperature coefficient of resistance, the base body extending along a median plane, the base body being confined by surfaces, wherein at least one surface is configured to electrically connect the base body, wherein:

an area of the at least one surface is larger than an area of a parallel projection of the base body in a direction perpendicular to the median plane; and the PTC-resistor is an injection molded PTC-resistor.

2. The PTC-Resistor according to claim 1, wherein the at least one surface comprises bumps.

3. The PTC-resistor according to claim 1, wherein the at least one surface comprises depressions.

4. The PTC-Resistor according to claim 2, wherein for each bump on the at least one surface, a corresponding depression is provided on an opposite surface of the base body.

5. The PTC-Resistor according to claim 1, wherein the at least one surface is coated with an electrically conductive layer.

6. The PTC-Resistor according to claim 5, wherein the surface of the base body that is opposite to the at least one surface is coated with an electrically conductive layer.

7. A method comprising:

using an injection-molding process to form a mold from a feedstock and using a sintering process to convert the feedstock to a PTC-ceramic to form a PTC-Resistor that includes:

a sintered base body comprising a ceramic material with a positive temperature coefficient of resistance, the base body extending along a median plane, the base body being confined by surfaces, wherein at least one surface is configured to electrically connect the base body, wherein an area of the at least one surface is larger than an area of a parallel projection of the base body in a direction perpendicular to the median plane.

8. The method of claim 7, further comprising coating the at least one surface with an electrically conductive layer.

9. The method of claim 8, further comprising coating the surface of the base body that is opposite to the at least one surface with an electrically conductive layer.

10. The method of claim 7, wherein the injection-molding process produces bumps on the at least one surface.

11. The method of claim 10, wherein for each bump on the at least one surface, the injection-molding process produces a corresponding depression on an opposite surface of the base body.

12. The method of claim 7, wherein the injection-molding process produces depressions on the at least one surface.

13. A PTC-resistor comprising:

a sintered base body comprising a ceramic material with a positive temperature coefficient of resistance, the base body extending along a median plane, the base body being confined by surfaces, wherein at least one surface is configured to electrically connect the base body, wherein:

an area of the at least one surface is larger than an area of a parallel projection of the base body in a direction perpendicular to the median plane;

the PTC-resistor is an injection molded PTC-resistor; and at least one surface of the base body comprises bumps and at least one opposite surface of the base body comprises depressions and for each bump on the at least one surface of the base body, a corresponding depression is provided on the at least one opposite surface of the base body and the at least one surface of the base body and the at least one opposite surface of the base body are each coated with an electrically conductive layer.

* * * * *